US006129021A

United States Patent [19]

Vrotacoe et al.

[11] Patent Number: 6,129,021

[45] Date of Patent: Oct. 10, 2000

[54] SMOOTH INK PRINTING APPARATUS AND METHOD

[75] Inventors: James Brian Vrotacoe, Rochester, N.H.; Edward Ellis Urquhart, Northboro, Mass.

[73] Assignee: Heidelberger Druckmaschinen AG, Heidelberg, Germany

[21] Appl. No.: 09/154,387

[22] Filed: Sep. 16, 1998

[51] Int. Cl.[7] ..... B41F 31/00

[52] U.S. Cl. ..... 101/492; 101/349.1

[58] Field of Search ..... 101/348, 349.1, 101/350.1, 350.2, 350.3, 350.4, 350.5, 350.6, 351.1, 351.2, 351.3, 351.4, 351.5, 351.6, 351.7, 351.8, 352.01, 352.02, 352.03, 352.04, 352.05, 352.06, 352.07, 352.08, 352.09, 352.1, 352.11, 352.12, 352.13, 148, 492

[56] References Cited

U.S. PATENT DOCUMENTS

| | | | |
|---|---|---|---|
| 4,777,877 | 10/1988 | Lemaster | 101/348 |
| 4,864,925 | 9/1989 | Van Kanegan et al. | 101/350.5 |
| 5,293,819 | 3/1994 | Fukuda | 101/350.5 |
| 5,523,122 | 6/1996 | Harada et al. | 427/287 |

*Primary Examiner*—John S. Hilten
*Assistant Examiner*—Amanda B. Sandusky
*Attorney, Agent, or Firm*—Kenyon & Kenyon

[57] ABSTRACT

A printing apparatus comprising a plate cylinder; at least one ink transfer roller for transferring ink to the plate cylinder; and a smoother associated with at least one of the at least one ink transfer roller for smoothing the ink on the ink transfer roller. Also provided is a method of providing ink for a printing apparatus comprising the steps of providing ink to an ink transfer roller transferring the ink to a plate cylinder; and smoothing the ink on the ink transfer roller using a smoother.

13 Claims, 2 Drawing Sheets

SMOOTH INK PRINTING APPARATUS AND METHOD

FIELD OF THE INVENTION

The present invention relates to printing presses, and more particularly to lithographic printing presses.

RELATED TECHNOLOGY

Often lithographic printing presses do not transfer a smooth film of ink onto the paper substrate. Typically, ink splitting using various rollers is used to split the ink stream and deliver ink at a variety of locations to a plate cylinder of a printing press. A non-smooth transfer of ink often results because the tension from nips of the ink rollers causes a rough transfer. Thus, the resulting ink film delivered to the plate from the ink form rollers is not smooth. Likewise, the ink film delivered to the paper from the blanket and the plate cylinders is rough. This ink film may have thick and thin areas and void areas substantially without ink. The problems resulting from the rough ink film, ultimately delivered to the paper, is termed in the art as poor "solid laydown."

SUMMARY OF THE INVENTION

The present invention provides a printing apparatus comprising: a plate cylinder; at least one ink transfer roller for transferring ink to the plate cylinder; and a smoother associated with at least one of the at least one ink transfer roller for smoothing the ink on the at least one ink transfer roller. The present invention minimizes the rough ink that causes poor solid laydown.

A smoother, e.g., a rubber tipped scraper blade, is applied to one or more ink transfer rollers, e.g., form rollers and vibrator rolls. The smoother advantageously may be located on the ingoing side of a nip between two rollers. The smoother produces a shearing action such that it essentially smooths out the film of ink on the roller. This smoothing of the ink is most effective when the nip desired to transfer the smooth ink film is the last nip of the ink transfer rollers contacting a plate cylinder, i.e., the nip before the plate cylinder and blanket cylinder nip.

The smoothing of the ink film creates smoother (more uniform) solids that will inherently produce a higher optical density in that area for the same amount of ink. Thus, the printing press consumes less ink because less ink is required to maintain the proper optical density.

The smoother according to the present invention reduces ghosting and starvation type printing defects formed from roller latent images.

The present invention also provides a method of providing a smooth ink for a printing apparatus comprising the steps of: providing an ink to an ink transfer roller, smoothing the ink on the ink transfer roller using a smoother, and transferring the ink to a plate cylinder.

BRIEF DESCRIPTION OF THE DRAWINGS

In the following, the present invention is explained in more detail with the aid of the drawings, in which.

DETAILED DESCRIPTION

Figure 1:
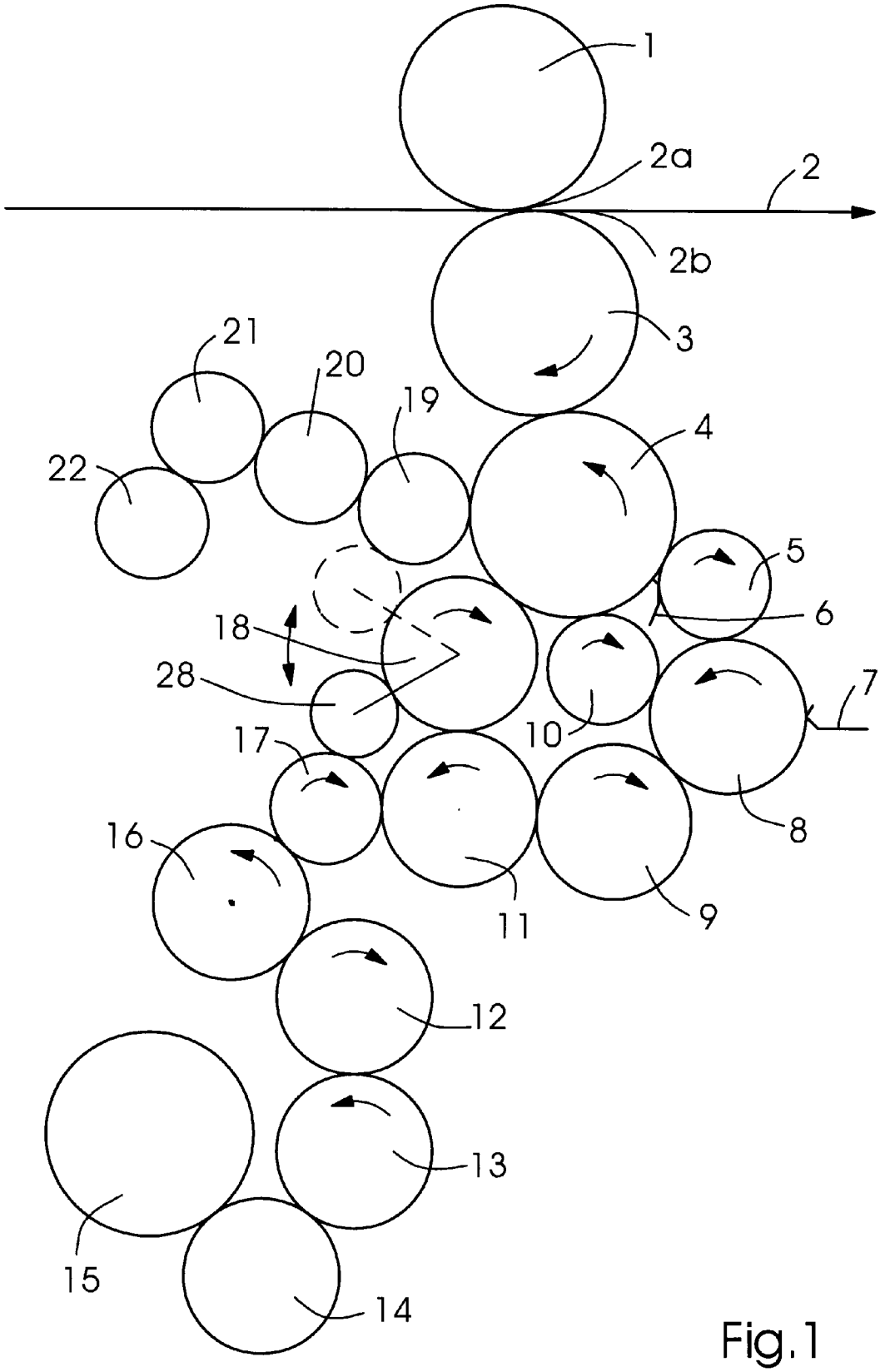
FIG. 1 shows an embodiment of the present invention having two smoothers.

FIG. 1 illustrates an offset printing apparatus of the present invention having two smoothers 6, 7. An ink fountain 15 transfers ink to a metering roll 14. The metering roll 14 transfers the ink to a distributing roller 13, which transfers the ink to another distributing roller 12. The distributing roller 12 then transfers the ink to vibrator roll 16 which transfers the ink to a swing roll 17. The swing roll 17 transfers the ink to, and splits the ink between, another vibrator roll 11 which transfers the ink to a large distributor roller 9 and an ink form roller 18.

The large distributor roller 9 transfers the ink to a vibrator roll 8. A smoother 7 is associated with the vibrator roll 8 and smooths the ink just before transferring the ink to a second ink form roller 10 and a third ink form roller 5. A smoother 6 is applied to the third ink form roller 5 and smooths the ink just before transferring the ink to a plate cylinder 4. The second ink form roller 10 also transfers the ink to the plate cylinder 4.

The first ink form roller 18 also transfers the ink to the plate cylinder 4. The plate cylinder 4 receiving and transferring the ink between the first ink form roller 18, the second ink form roller 10, and the third ink form roller 5, transfer the ink to a blanket cylinder 3.

The smoother 6 is positioned advantageously directly before the last ink transfer nip of the nips between the ink form rollers 5, 10, and 18 and the plate cylinder 4. This provides effective smoothing of the ink transferred to the blanket cylinder 3.

The blanket cylinder 3 transfers the ink to a side 2*b* of a web of material 2 while another blanket cylinder 1 transfers the ink to a side 2*a* of the web of material 2.

A dampening form roller 19 provides water or a dampening solution through rollers 20, 21, and 22. The roller 22 is associated with a water or dampening solution supply.

Figure 2A:
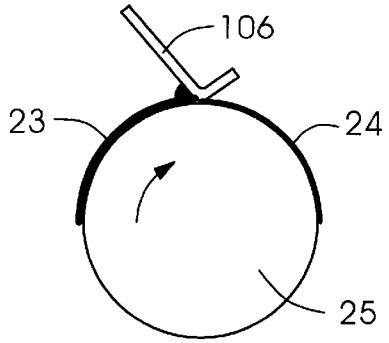
FIG. 2A shows an embodiment of the present invention having a flexible blade smoother.
Figure 2B:
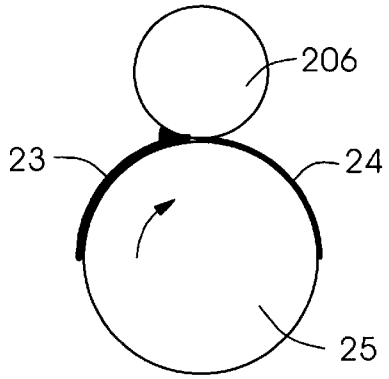
FIG. 2B shows an embodiment of the present invention having a stationary roller smoother.
Figure 2C:
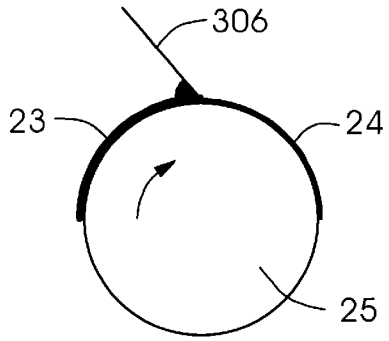
FIG. 2C shows an embodiment of the present invention having a flexible film smoother.
Figure 2D:
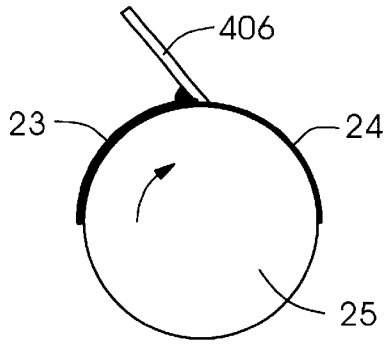
FIG. 2D shows an embodiment of the present invention having a rigid blade smoother.

FIGS. 2A–2D illustrate various embodiments of the smoothers of the present invention, e.g., for use as smoothers 6 and 7 in FIG. 1. FIG. 2A shows a flexible blade smoother 106 associated with a roller 25. As the roller 25 spins and flexible blade smoother 106 remains stationary, a rough ink 23 passing between the flexible blade smoother 106 and roller 25 is smoothed by the flexible blade smoother 106 into a smooth ink 24. The flexible blade smoother 106 may be made, for example, of a polymeric material. Alternatively, just the tip of the flexible blade smoother 106 may be made of a polymeric material. FIG. 2B shows a stationary roller smoother 206 used to smooth the rough ink 23 situated on the roller 25. The roller 206 does not rotate. FIG. 2C shows a flexible film smoother 306 used to smooth the rough ink 23 situated on the roller 25. The flexible, film, and rigid smoothers also may be made of a polymeric material. FIG. 2D shows a rigid blade smoother 406 used to smooth the rough ink 23 situated on the roller 25.

The present invention is not limited to the various embodiments described herein and further is applicable to other types of printing presses in which ink smoothing may be advantageous. It should be recognized that the smoothers may be provided for several of the transfer rollers.

As defined herein, form rollers are a subset of transfer rollers, the form roller being the transfer roller which directly contacts the plate cylinder.

What is claimed is:

1. A printing apparatus comprising:

a plate cylinder;

at least a first and a second ink form roller;

an ink transfer roller for splitting ink from the ink transfer roller to the first ink form roller and the second ink form roller;

a first smoother associated with the ink transfer roller for smoothing the ink on the ink transfer roller; and a second smoother associated with the first ink form roller for smoothing the ink on the first ink form roller, the second smoother located directly before the nip formed between the plate cylinder and the ink form roller.

2. The printing apparatus as recited in claim 1 wherein the ink transfer roller is a vibrator roller.

3. The printing apparatus as recited in claim 1 wherein at least one of the first smoother and the second smoother is a flexible blade.

4. The printing apparatus as recited in claim 1 wherein at least one of the first smoother and the second smoother is a stationary roller.

5. The printing apparatus as recited in claim 1 wherein at least one of the first smoother and the second smoother is a flexible film.

6. The printing apparatus as recited in claim 1 wherein at least one of the first smoother and the second smoother is a rigid blade.

7. The printing apparatus as recited in claim 1 wherein at least one of the first smoother and the second smoother is a scraper blade, the scraper blade including a tip made of a polymeric material.

8. The printing apparatus as recited in claim 1 wherein the first ink form roller forms a nip with the plate cylinder, and further comprising a blanket cylinder forming a second nip with the plate cylinder.

9. The printing apparatus as recited in claim 8 wherein the nip is directly before the second nip.

10. A printing apparatus comprising:

a plate cylinder;

a blanket cylinder forming a nip with the plate cylinder;

a first ink form roller, contacting the plate cylinder;

a second ink form roller, contacting the plate cylinder;

a transfer roller for splitting ink from the transfer roller to the first ink form roller and the second ink form roller;

a first smoother associated with the transfer roller for smoothing the ink on the transfer roller; and a second smoother associated with the first ink form roller for smoothing the ink on the first ink form roller, the second smoother located directly before the nip formed between the plate cylinder and the ink form roller, wherein the first ink form roller transfers the ink to the plate cylinder directly before the nip between the plate cylinder and the blanket cylinder.

11. The printing apparatus as recited in claim 10 further comprising a damp form roller for providing a dampening solution to the plate cylinder.

12. A method of providing a smooth ink for a printing apparatus comprising the steps of:

providing an ink to an ink transfer roller;

smoothing the ink on the ink transfer roller using a first smoother;

splitting the ink from the ink transfer roller to a first ink form roller and a second ink form roller;

providing a second smoother located directly before a nip formed between a plate cylinder and the first ink form roller;

smoothing the ink on the first ink form roller using the second smoother; and transferring the ink to the plate cylinder.

13. The method as recited in claim 12 further comprising: providing a dampening solution to the plate cylinder.

* * * * *